US005836408A

United States Patent [19]

Kleine et al.

[11] Patent Number: 5,836,408

[45] Date of Patent: Nov. 17, 1998

[54] ROTARY PERCUSSION BLOW ASSISTED DRILL

[75] Inventors: Werner Kleine, Achim; Axel Neukirchen, Drensteinfurt; Werner Bongers, München, all of Germany

[73] Assignee: Hilti Aktiengesellschaft, Schaan, Liechtenstein

[21] Appl. No.: 762,182

[22] Filed: Dec. 9, 1996

[30] Foreign Application Priority Data

Dec. 7, 1995 [DE] Germany ..... 195 45 646.7

[51] Int. Cl.[6] ..... E21B 10/44

[52] U.S. Cl. ..... 175/293; 175/419

[58] Field of Search ..... 175/293, 296, 175/414, 415, 417, 419, 420

[56] References Cited

U.S. PATENT DOCUMENTS 2,776,819 1/1957 Brown ..... 175/419 X
3,858,671 1/1975 Kita et al. ..... 175/414 X
5,002,139 3/1991 Haussmann et al. ..... 175/415 X

*Primary Examiner*—William P. Neuder
*Attorney, Agent, or Firm*—Anderson, Kill & Olick, P.C.

[57] ABSTRACT

A rotary percussion blow assisted drill has an axially extending shank (1) with at least one main helically extending groove (4) in its axially extending outside surface (2) for conveying drilled material along the shank. A cutting plate (6) with hard metal cutting edges (7) is located in a cutting head end region (10) of the shank. The cutting edge (7) of the cutting plate (6) projects axially outwardly from a cutting head end face (3) of the shank (1) and the opposite ends of the cutting plate project radially outwardly from the outside surface of the shank. At least one pin-shaped guide element (11) is embedded into the outside surface (2) in the head end region (10) of the shank. The guide element (11) has a central axis disposed substantially perpendicularly to the axis of rotation (A) of the shank (1) and has a free end face (12) located radially outwardly from the outside surface of the shank by a dimension less than the dimension which the ends of the cutting plate are spaced radially outwardly from such outside surface.

15 Claims, 2 Drawing Sheets

ROTARY PERCUSSION BLOW ASSISTED DRILL

BACKGROUND OF THE INVENTION

The present invention is directed to a rotary percussion blow assisted drill with an axially extending shank having a cutting end and an axially extending outside surface with at least one main helically extending conveying flute or groove in the outside surface for the removal of drilled materials. A cutting blade with hard metal cutting edges is fitted into the cutting head end region of the shank and the cutting blade projects axially outwardly from the cutting head end and radially outwardly from the outside surface of the shank.

Rotary percussion blow assisted drills are drill bits which are used together with axial blow assisted rotary drilling tools. In particular, such drills are used in rock or masonry for drilling holes. A rotary percussion blow assisted drill or drill bit is known from DE-A-39 19 264 and comprises a shank with at least one conveying flute or groove in its outside surface which runs helically from the shank head end in the direction of the chuck end of the drill. A hard alloy or hard metal cutter is provided in the shank head end projecting outwardly from the end face of the shank head. The cutting edges are formed as hard alloy pins which project from the end face of the shank head end. In particular, this known rotary percussion blow assisted drill has at least one centrally arranged and two peripherally arranged hard alloy pins located on a diameter of the shank head end so that they are positioned opposite one another.

The peripheral or outer hard alloy pins are spaced from the central pin and they are inserted into the end face of the shank head end so that they project radially beyond the outside surface of the shank. These pins have a polygonal cross sectional shape and are inserted in an inclined position relative to the axis of the shank, so that only the cutting edges come into engagement at their outer ends with the borehole wall. While the central hard alloy pin acts as a centering member, this known drill has only inadequate side guidance in the borehole during actual drilling operation. Therefore, it can occur that the prepared receiving bore becomes too large or the drill bit jams or tilts in the borehole being drilled. Due to the inclined arrangement of the peripheral hard alloy pins relative to the axis of the shank, high radial forces act on the pins which are not bordered on all sides and such radial forces can cause loosening or disengagement whereby the pins drop out of the drill.

Another known drill, disclosed in EP-A-0 226 534, has a hard alloy cutting blade formed in the shank head end of the drill with the blade extending across the entire diameter of the drill shank. The hard alloy cutting blade is inserted into a groove extending continuously across the head end of the shank. In addition to the cutting blade, cutting pins are provided which project at the shank head end from the end face of the shank or from its outside surface. The free ends or outer ends of the cutting pins lie in a rotational surface generated or developed by the cutting edges of the hard alloy blade. The outwardly projecting free end faces of the cutter pins which project beyond the outer surface of the shank are in contact with the borehole wall or surface during the drilling operation and become roughened during the drilling operation. While with this known rotary percussion blow assisted drill, a certain guidance of the drill bit within the borehole being prepared is afforded, the operation is somewhat sluggish because of the predominantly abrasive effect of the cutter pins moving along the borehole wall and the drilled material removal output is diminished.

SUMMARY OF THE INVENTION

Therefore, the primary object of the present invention is to improve a rotary percussion blow assisted drill to such an extent that an optimum guidance of the drill in a borehole being formed is assured. A rotary percussion blow assisted drill is provided which runs smoothly in actual operation and does not have the tendency to jam and affords a high drilled material removal output. Further, such a drill is simple in form and economical to manufacture.

In accordance with the present invention, at least one pin shaped guide element has a central axis extending substantially perpendicularly to the axis of rotation of the drill. The guide element is embedded in the cutting head end region of the drill and has a free end or outer end spaced radially outwardly by a given dimension from the outside surface of the drill and such dimension is less than the dimension at which the end of the cutting blade or blade extends radially outwardly from the outer surface of the shank. With such an arrangement of at least one pin-shaped guide element, it is possible to obtain an effective guidance of the drill in the borehole, without experiencing the disadvantage of a certain sluggish operation due to an abrasive effect. Further, a high output of the drilled material is obtained. The pin-shaped guide element does not participate in the drilled material removal operation, it functions exclusively as a guide member. As a result, the guide element can be built very ruggedly without having to consider the arrangement of a cutting edge. Since the pin-shaped guide element is embedded in the shank around its entire circumference, an optimum retention in the shank is obtained. The substantially perpendicular orientation of the central axis of the guide element relative to the axis of rotation of the shank facilitates the manufacture of the rotary percussion blow assisted drill embodying the present invention. In forming the shank, only a bore of sufficient depth extending perpendicularly to the axis of the shank is needed into which the pin-shaped guide element is inserted.

In an advantageous embodiment, two or more pin-shaped guide elements are employed and are arranged in pairs in diagonally opposite quadrants of a cross-section extending perpendicularly to the axis of the shank. The arrangement in pairs is chosen for reasons of symmetry. In this way sufficient clearance remains for the arrangement of the grooves or flutes for removing the drilled material. With a cutting blade, equipped with hard alloy or hard metal cutting edges, enclosed in a groove in the head end face of the shank, it is possible to provide one removal groove in the space between the pin-shaped guide element and the cutting blade. By varying the position of the pin-shaped guide elements, the available space can be changed so that wider main removal grooves can be provided located upstream of the main cutting edges at the center of the cutting blade. It is also possible to provide a secondary narrower removal groove located between the pin shaped guide element and the main cutting edge of the cutting blade. In the region between the pin-shaped guide element and the trailing portion of the cutting blade in the rotational direction, it is also possible to provide a narrower drilled material groove. For reasons of symmetry and to obtain an optimum concentric rotation of the drill, the pin-shaped guide elements are preferably disposed diagonally opposite one another with their axis lying on a single diameter of the shank. The angle at which the pin-shaped guide elements are offset relative to the radially projecting ends of the cutting blade can be varied as required. An acute angle is advantageously selected, so that one relatively wide main drilled material disposal groove is located upstream in the rotational direction of a main cutting edge.

To assure that the pin-shaped guide elements are securely embedded into the shank, they are preferably spaced from the head end of the shank by an amount in the range of ¼ to ¾ of the embedded length of the hard metal cutting blade. Such spacing refers to the position of the central axis of the guide elements. Accordingly, the guidance of the drill occurs precisely in that region exposed to the largest loads, because of the cutting engagement of the hard metal cutting edges with the borehole wall. The guide pins can be embedded in the shank at the same distance from the head end face of the shank or at different spacings.

To achieve the best possible dimensional accuracy of a prepared borehole, it is advantageous if the pin-shaped guide elements have an outward projection from the outside surface of the shank equal at least to one-half the radial projection of the hard metal cutting blade. In case the cutting end of the drill strikes gravel, the head end of the shank carrying the cutting blade tends to move to the side. The pin-shaped guide elements counteract such movement. The extent of the outward projection of the pin-shaped guide elements thus determines the maximum travel available for deviation of the head end of the shank. As a result, the best possible concentric rotation is assured without the pin-shaped guide elements being in continuous engagement with the wall of the borehole being formed.

Since the free or outwardly projecting end face of the pin-shaped guide elements extending outwardly from the outside surface of the shank is at least partially curved, the abrasive action of the guide elements on contact with the wall of the borehole is clearly reduced. The outwardly projecting end face has preferably the curvature of the surface of a spherical or cylindrical surface, with such curvature being adapted to the curvature of the outside surface of the shank.

It is particularly helpful in the manufacture of the rotary percussion blow assisted drill embodying the present invention if the pin-shaped guide elements have a circularly shaped cross section. With such an arrangement, the receiving bores and the shank for the guide elements can be fabricated in a very simple manner if they have a similar circularly shaped cross section. During insertion of the pin-shaped guide elements, it is important to note the axial orientation in embodiments where the end faces of the pin-shaped guide elements are spherically shaped. In case of a symmetrical design of the opposite end faces, it is not necessary to pay attention to the orientation of the guide elements during assembly. In such an arrangement, it is of no import whether the guide elements are inserted with one or the other of their end faces in the outwardly projecting position. This simplifies the assembly of the pin-shaped guide elements into the shank of the drill.

It is advantageous if a depth stop is provided on the guide elements for assisting in the installation to assure in a simple manner that the guide elements have a defined outward projection relative to the outside surface of the shank. This can be effected by arranging one or several pin-shaped guide elements in the outside surface of the drill. If the guide elements do not have a symmetrical arrangement of their end faces, the guide elements can have a head at one end widened in a mushroom-like manner forming a shoulder which, during installation, bears against the outside surface of the shank with the head projecting to the desired amount from the outside surface. By forming depth stops on the pin-shaped guide elements, the depth of the receiving bores extending substantially perpendicularly to the axis of the rotation of the shank does not have to be accurately controlled. Only a minimum depth of the receiving bores must be provided. The outward projection of the end face of the pin-shaped guide elements is determined by the depth stop.

In an advantageous embodiment, the guide elements are embedded into a continuous groove extending across the head end of the shank, that is, extending across a diameter of the shank. Such a feature makes it easier to manufacture the drill. Bores with an accurately defined depth do not have to be prepared. In addition to the groove for receiving the cutting blade, an additional groove is milled into the shank end for receiving the guide elements and such additional groove is aligned at the desired angle to the groove for the cutting blade. Such groove can be continuous, however, grooves can be formed which do not lie along a common diameter. The fastening of the guide elements in the groove can be effected by soldering.

It has been noted that it is advantageous for the stability of the guide elements fixed in the shank if they are embedded in the shank in the range of approximately three fifths to three-quarters of their length.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
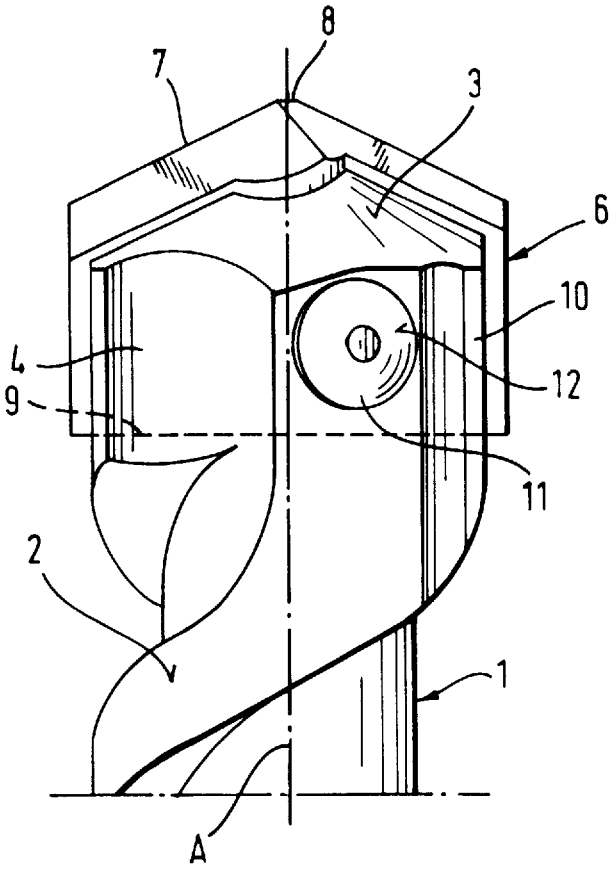
FIG. 1 is a side view of the cutting head end of a first embodiment of a rotary percussion blow assisted drill embodying the present invention.
Figure 2:
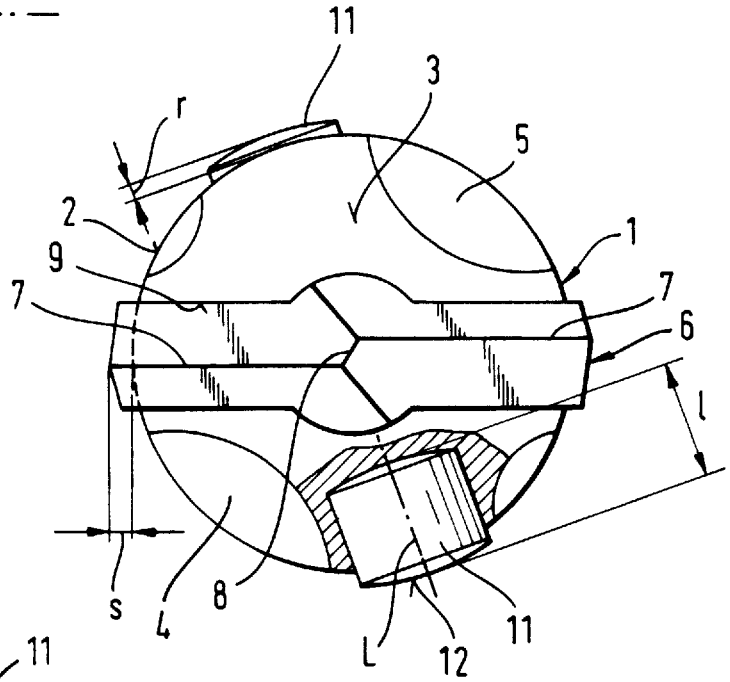
FIG. 2 is a plan view, partly in section, of the cutting head end of the drill shown in FIG. 1.

In the embodiment illustrated in FIGS. 1 and 2, the rotary percussion blow assisted drill of the present invention comprises an axially extending shank 1 with two main conveying grooves 4, 5 for removing drilled material extending helically in the axially extending outside surface 2 of the drill. Only the cutting head end of the drill is shown in FIG. 1 having a cutting head end face 3 in which a hard metal cutting blade 6 is recessed. The cutting plate or blade 6 has hard metal cutting edges 7 sloping radially outwardly and rearwardly from a cutting tip edge 8. The surface of the cutting plate 6 slopes outwardly and rearwardly in a peaked roof-shaped manner from the cutting edges 7. Further, the cutting plate is fixed in a groove in the head end face 3 of the shank with the groove extending across a full diameter of the shank. The cutting plate can be secured in the groove by soldering.

Two pin-shaped guide elements 11 are embedded in the outside surface 2 of the shank 1 in the head end shank region 10 extending rearwardly from the cutting head end face 3. The pin-shaped guide elements 11 each project radially outwardly from the outside surface 2 of the shank with a free end face 12 spaced radially outwardly from the outside surface. The radially outward dimension r of the guide element 11 is smaller than the radially outward end dimension s of the cutting plate which also projects radially outwardly from the outside surface 2 of the shank. The dimension r of the free end face 12 corresponds at least to half the radially outward dimension s of the cutting plate 6. In this way it is assured that the guide elements 11 are not involved in the material removal operation, rather they only form a guidance function for the drill. The guide elements 11 are secured in the shank so that their central axes L extend substantially perpendicularly to the axis of rotation A of the shank 1.

The rotary percussion blow assisted drill can have two guide elements 11 as is shown in FIG. 2. It is possible, however, to provide only one guide element, such as displayed in the side view of the drill in FIG. 1. If more than one guide element 11 is provided in the head end region 10 of the shank, preferably the elements are provided in pairs located in diagonally opposite quadrants of a cross section of the shank extending perpendicularly to its axis of rotation A. As shown in the drawing, the longitudinal axes L of the guide elements 11 are located on a single diameter of the shank 1. Such arrangement, however, is not necessarily required. The guide elements 11 can be held in the head end region 10 of the shank with their central axes disposed on a straight line spaced from a diameter of the shank 1 and the straight line can run parallel to or be inclined to a shank diameter. Advantageously, the central axes L of the guide elements 11 can form an acute angle with the cutting plate 6. Accordingly, the main drilled material conveying grooves 4, 5 can lead the hard metal cutting edges 7 in the rotational direction and can be formed wider.

The guide elements 11 are secured in the shank 1 so that their longitudinal axes L each has a spacing relative to the head end face 3 of the shank amounting to approximately ¼ to ¾ of the length of the cutting plate 6 embedded in the head end face. As shown in FIG. 2, the guide elements are secured in the head end region of the shank for approximately ⅗ to ¾ of their length.

Figure 3:
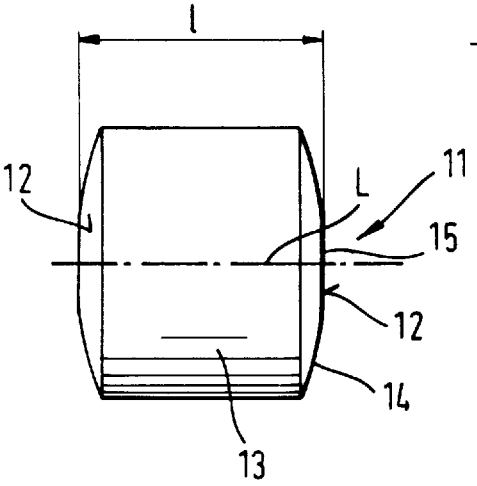
FIGS. 3 and 4 illustrate two embodiments of pin-shaped guide elements.
Figure 4:
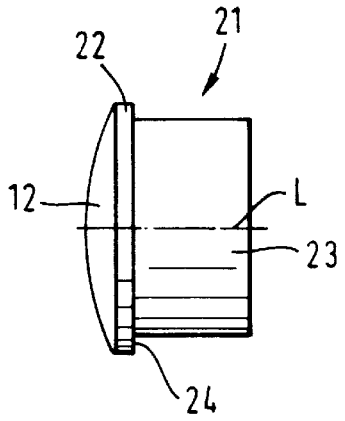

In FIGS. 3 and 4, two embodiments of the guide elements 11 are illustrated. In each case, the guide elements 11 have a circularly shaped cross section. Such a configuration, however, is not necessarily required, since the guide elements can also have a polygonal cross section, for instance, either hexagonal or octagonal.

In FIG. 3 the guide element 11 has two identically designed end faces 12 so that the central axes of the guide elements can be turned through 180° for embedding either one of the end faces in the shank. The curvature of the end face 12 of the guide element 11 shown in FIGS. 1 and 3 is matched to the curvature of the outside surface 2 of the shank 1. The end face 12 has an annularly shaped segment 14 with a spherical surface adjoining the cylindrical surface 13 of the guide element encircling its central axes L. The radius of curvature of the spherical surface corresponds substantially to the radius of curvature of the outside surface 2 of the shank. The central region 15 of the end face 12 within the annular surface 14 has a planar shape, however, it can also be formed with the curvature of a cylindrical surface.

In FIG. 4, another guide element 21 is shown formed with a depth stop. The depth stop is formed with an annular shoulder 24 extending transversely of the central axes L and extending radially outwardly from a cylindrical section 23 of the guide element. The free end face 12 of the guide element 21 forms a head 22 with a mushroom-shaped configuration projecting radially outwardly from the cylindrical section 23 of the guide element 21. The radius of curvature of the free end face 12 corresponds to the radius curvature of the outside surface 2 of the shank 1. The free end face 12 can be formed of different surface sections as explained in the embodiment of FIG. 3. The free end face 12 of the guide element, however, can be also formed by a spherical surface having a suitable radius of curvature as displayed in FIG. 4.

Figure 5:
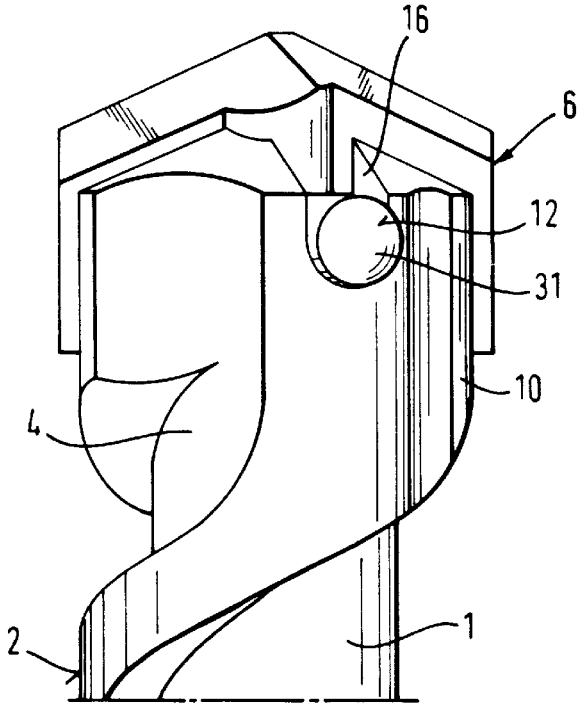
FIG. 5 is a side view, similar to FIG. 1, of a second embodiment of a rotary percussion blow assisted drill embodying the present invention.
Figure 6:
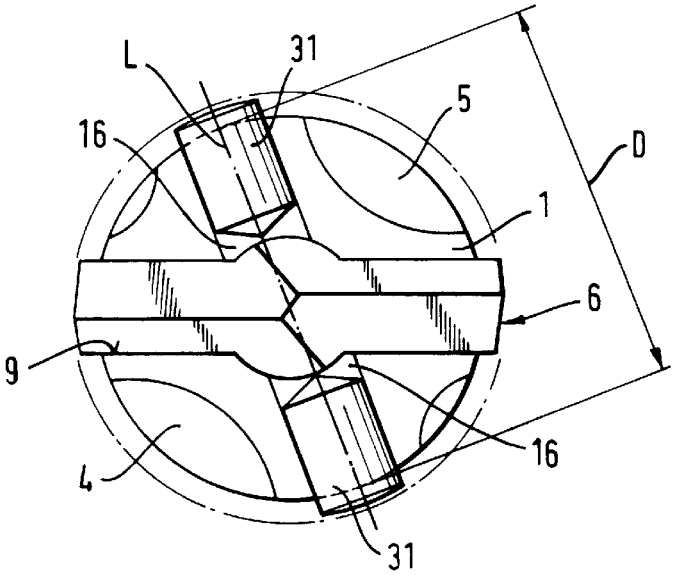
FIG. 6 is a plan view of the cutting head end of the drill shown in FIG. 5.

In the embodiment set forth in FIGS. 1 and 2, the guide elements 11 are inserted into bores extending perpendicularly to the axis of rotation A of the shank with their entire circumference embedded into the shank 1. In an alternate embodiment of the drill of the present invention, as shown in FIGS. 4 and 5, the guide elements are embedded into a groove formed in the head end face 3 of the shank. The guide elements 31 are secured in the open groove 16 by soldering. The groove 16, as illustrated, is formed as a continuous groove extending across a diameter D of the shank and being inclined at an acute angle relative to the groove 9 in which the cutting plate 6 is secured. It is also possible, however, to provide separate grooves for securing each guide element with the grooves located on a straight line offset from a diameter D with such line extending parallel to or inclined relative to the diameter D. The depth of the groove 16 extending in the direction of the axes of rotation of the shank is such that the central axes L of the guide elements 31 are spaced from the head end face 3 of the shank 1 by an amount in the range of approximately ¼ to ¾ of the embedded length of the cutting plate 6.

Excellent guidance of the drill in a borehole being formed is achieved, without the disadvantage of a certain slowed down operation because of the abrasive effect, since the at least one pin-shaped guide element in the drill, while projecting radially outwardly beyond the surface of the shank, projects for a dimension less than the radial outward dimension of the ends of the cutting plate. Since the pin-shaped guide element does not participate in the material removal operation, it fulfills an exclusively guide function and, therefore, can be designed to be very rugged without consideration of a cutting edge geometry. Since the pin-shaped guide elements are embedded into the shank for a considerable part of their length, there is optimum retention in the shank. The substantially perpendicular orientation of the central axis of the guide element relative to the axis rotation of the shank facilitates manufacture of the drill embodying the present invention.

While specific embodiments of the invention have been shown and described in detail to illustrate the inventive principles, it will be understood that the invention may be embodied otherwise without departing from such principles.

What is claimed is:

1. A rotary percussion blow assisted drill comprising an axially extending shank (1) having an axis of rotation (A) with a cutting head end face (3) and an axially extending outside surface (2) with at least one main helically extending conveying groove in said outside surface for the removal of drill material from said cutting head end, a cutting plate (6) with hard metal cutting edges (7) having an axial extension fitted into a cutting head end region (10) of said shank (1) extending inwardly from said cutting head end face, said cutting plate (6) projects axially outwardly from said cutting head end (3) and radially outwardly by a dimension (s) from said outside surface (2), at least one pin-shaped guide element (11, 21, 31) having a central axis (L) extending substantially perpendicularly to the axis of rotation (A) of said shank and embedded in said cutting head end region (10) within a range of the axial extension of said cutting plate inwardly from said cutting head end face, said guide element (11, 21, 31) being spaced circumferentially from said cutting plate and having a non-cutting free end face (12) spaced radially outwardly by a dimension (r) from said outside surface (2), and the dimension (r) being less than the outward dimension (s) of said cutting plate (6).

2. A rotary percussion blow assisted drill, as set forth in claim 1, wherein more than one said pin-shaped guide element (11, 21, 31) is located in said cutting head end region (10), and said guide elements (11, 21, 31) being arranged in pairs in diagonally opposite quadrants of a cross section of said shank extending perpendicularly to the axis of rotation (A) of said shank (1).

3. A rotary percussion blow assisted drill, as set forth in claim 2, wherein said pin-shaped guide elements (11, 21, 31) are disposed in pairs arranged diametrically opposite one another.

4. A rotary percussion blow assisted drill, as set forth in claim 3, wherein each said pair of guide elements (11, 21, 31) being arranged on a diameter of said shank (1).

5. A rotary percussion blow assisted drill, as set forth in claim 3, wherein said central axes (L) of said pin-shaped guide elements (11, 21, 31) are spaced from said cutting head end face (3) in the range of approximately ¼ to ¾ of the axial length of said cutting plate (3) inwardly from said cutting head end face.

6. A rotary percussion blow assisted drill, as set forth in claim 3, wherein said dimension (r) of the outward projection of said pin-shaped guide elements (11, 21, 31) from the outside surface (2) of said shank (1) corresponds to at least ½ of the radial outward projection (s) of said cutting plate (6) from the outside surface (2) of said shank (1).

7. A rotary percussion blow assisted drill, as set forth in claim 3, wherein said free end faces (12) of said pin-shaped guide elements (11, 21, 31) being at least partially curved with a curvature thereof coinciding with a curvature of the outside surface (2) of said shank (1).

8. A rotary percussion blow assisted drill, as set forth in claim 7, wherein said partially curved free end faces (12) have a spherical surface.

9. A rotary percussion blow assisted drill, as set forth in claim 7, wherein said partially curved free end faces (12) form part of a cylindrical surface.

10. A rotary percussion blow assisted drill, as set forth in claim 3, wherein said guide elements (11, 21, 31) have a circular cross section extending transversely of the central axes (L) thereof and have symmetrically shaped opposite end faces.

11. A rotary percussion blow assisted drill, as set forth in claim 3, wherein said pin-shaped guide elements (21) comprise a depth stop for limiting a depth of the insertion of said guide elements into said shank.

12. A rotary percussion blow assisted drill, as set forth in claim 11, wherein said depth stop comprises a mushroom-shaped head (22) having a first circumferentially extending outside surface projecting radially outwardly, a second circumferentially extending surface of said guide elements arranged to be closely fitted into a bore in said shank (1).

13. A rotary percussion blow assisted drill, as set forth in claim 3, wherein said pin-shaped guide elements (11, 21, 31) are positioned in a groove (16) formed in the cutting head end region (10) of said shank and extending inwardly from said cutting head end face (3).

14. A rotary percussion blow assisted drill, as set forth in claim 13, wherein said groove (16) extends along a diameter (D) of said shank (1).

15. A rotary percussion blow assisted drill, as set forth in claim 3, wherein said pin-shaped guide elements (11, 21, 31) are embedded in said shank (1) for a length in the range of approximately ⅗ to ¾ of the length of said guide elements extending along the central axis (L) thereof.

* * * * *